US005997403A

United States Patent [19]

Fonti

[11] Patent Number: 5,997,403

[45] Date of Patent: Dec. 7, 1999

[54] SPINNING PLAYGROUND EQUIPMENT

[75] Inventor: Michael A. Fonti, Springfield, Mo.

[73] Assignee: Miracle Recreation Equipment Company, Monett, Mo.

[21] Appl. No.: 09/173,014

[22] Filed: Oct. 15, 1998

[51] Int. Cl.[6] ..... A63G 1/16

[52] U.S. Cl. ..... 472/19; 472/20; 472/131

[58] Field of Search ..... 472/14, 19, 24, 472/135, 118, 131; 482/35, 37; 446/241

[56] References Cited

U.S. PATENT DOCUMENTS

| | | | |
|---|---|---|---|
| 3,090,617 | 5/1963 | Hjelte et al. | 472/19 |
| 4,027,874 | 6/1977 | Buckholtz, Jr. . | |
| 4,234,152 | 11/1980 | Browse . | |
| 4,639,232 | 1/1987 | Wang | 446/220 |
| 4,978,120 | 12/1990 | Greenwood | 472/118 |
| 5,683,301 | 11/1997 | Dunn, Jr. et al. . | |
| 5,720,524 | 2/1998 | Hall . | |

*Primary Examiner*—Kien T. Nguyen
*Attorney, Agent, or Firm*—Polster, Lieder, Woodruff & Lucchesi

[57] ABSTRACT

A spinning play device for children is disclosed. The spinning play device includes a rotating mechanism mounted to a frame a predetermined distance above a supporting surface and a handhold depending from the rotating mechanism to allow a user to grip the handhold during rotation of the rotating mechanism. The rotating mechanism includes a rotating element that is weight activated by a user's weight. From its lowermost position, the rotating mechanism may be returned to its uppermost position by vertical or linear movement only.

20 Claims, 10 Drawing Sheets

SPINNING PLAYGROUND EQUIPMENT

BACKGROUND OF THE INVENTION

Children love playground equipment that facilitate and promote movement from simple activity. Swings, teeter-totters, and slides are good examples of such equipment. Children also enjoy climbing on monkey bars, being spun by a merry-go-round, and kicking their legs on a swing set. The on-going popularity of the merry-go-round pointedly demonstrates how much kids like to move in a circle. Kids simply like to spin, as is also evidenced by U.S. Pat. Nos. 5,720,524 and 4,234,152.

However, children look for variety in their play and do not especially like this play to be centered around sitting, as devices in the aforementioned patents require. The spinning play device of the present invention allows children, through minimal effort, to spin their whole bodies with only their hands being connected to the spinning device, which is their sole support. Other than the hands, the children's bodies are left to free and total movement as the applied body weight creates a rotational motion.

BRIEF SUMMARY OF THE INVENTION

Accordingly, among the several objects and advantages of the present invention include:

The provision of a spinning play device providing motion to a child's body;

The provision of the aforementioned spinning play device in which the child's body is suspended;

The provision of the aforementioned spinning play device through in which a handhold provides the suspension;

The provision of the aforementioned spinning play device which the child's weight actuates the rotational motion in a downward direction;

The provision of the aforementioned spinning play device in which rotation is provided by a vertical rotating element;

The provision of the aforementioned spinning play device in which a clutch mechanism permits the rotating element to be returned to its uppermost position in a linear, non-rotational path;

The provision of the aforementioned spinning play device which is permanently mounted and suspended from a support;

The provision of the aforementioned spinning play device enabling such equipment to comply with current and applicable ASTM standards for public playground equipment.

Briefly stated, the spinning play device of the present invention includes a rotating element within a fixed, suspended housing. The housing is suspended above a floor or ground surface by a generally permanent structure such as a frame. A handhold is attached to the rotating element to produce free and unrestricted spinning movement for a child using the device.

The rotating element includes a threaded shaft integral with a depending handhold. The rotating element is mounted by a bearing within a bracket, providing stability in movement.

Starting with the rotating element in its uppermost position, when the handhold is gripped, the application of body weight actuates the rotating element, thus producing a spinning motion. While spinning, the user's body is free to move in any manner desired.

As the spinning play device nears its lowest downwardly position, the device gradually slows but does not stop abruptly. Once the full path has been traveled, i.e. the rotating element is in its lowest downwardly position, the user may directly return the rotating element to its uppermost position by applying force in an upward direction along the central axis of the rotational movement, thereby causing a clutch to release. This allows a quick return for re-use of the equipment and obviates the need to rotationally screw the device back to its original, uppermost position.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 7:
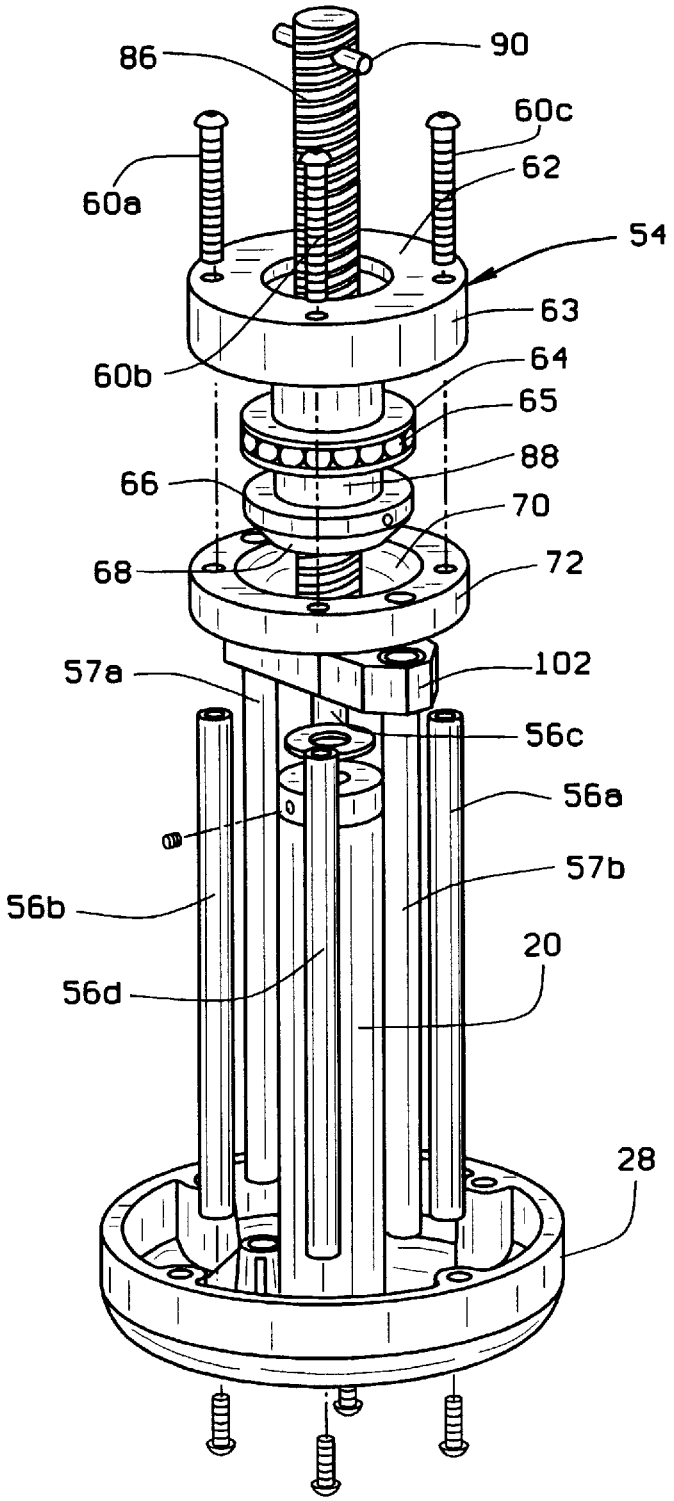
FIG. 7 is an exploded perspective view of the spinning play device of the present invention.
Figure 8:
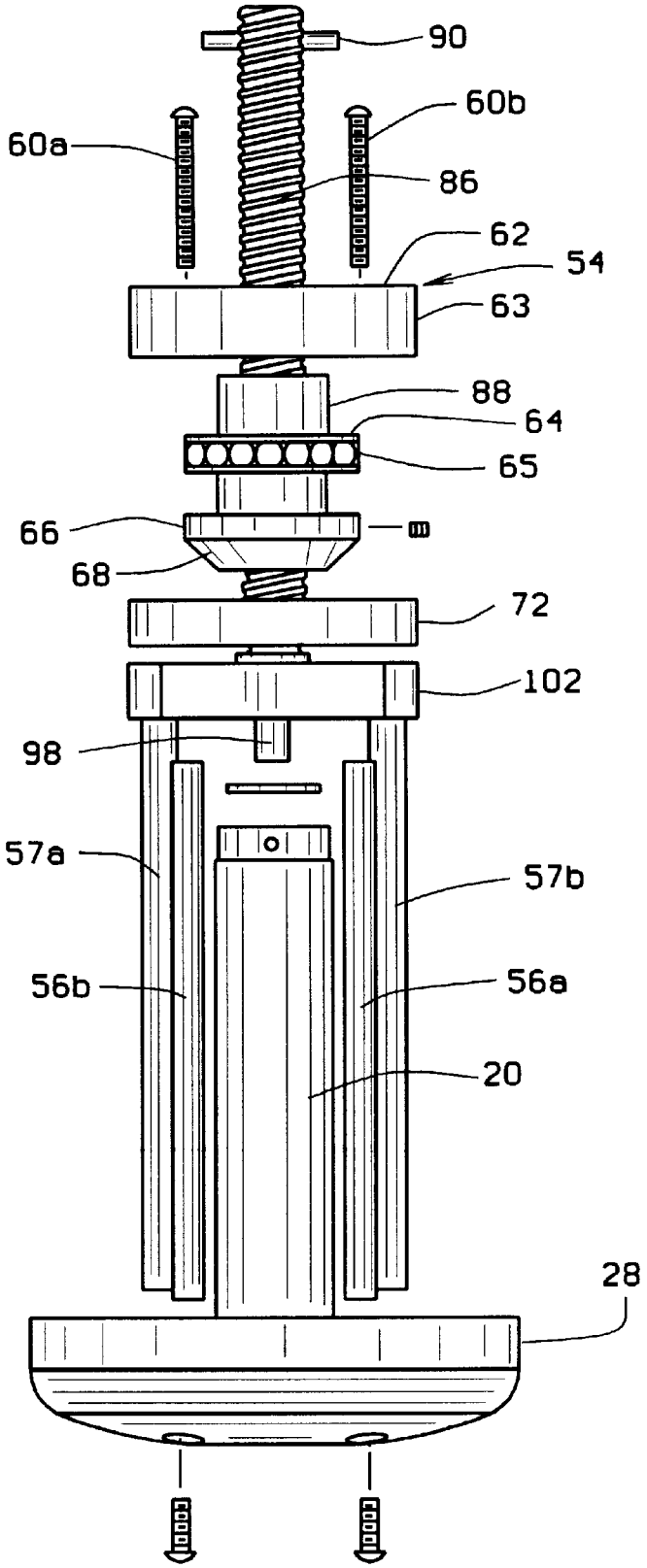
FIG. 8 is an exploded elevational view of the spring play device of the present invention.
Figure 9:
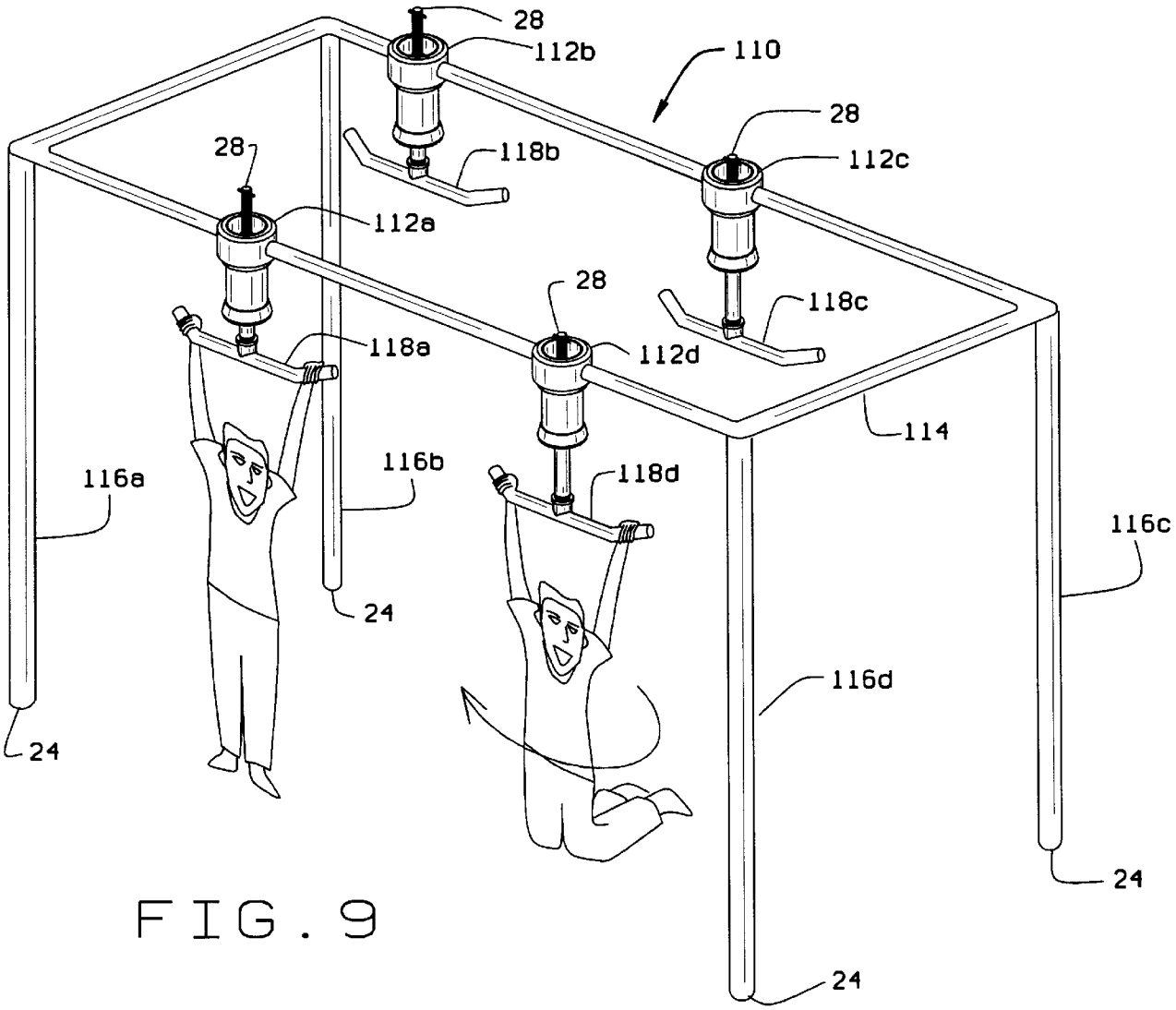
FIG. 9 is a perspective view of one alternative embodiment of the spinning play device of the present invention.

FIGS. 1–8 illustrate the preferred embodiment of the spinning play device while one alternative embodiment is shown in FIG. 9.

Figure 1:
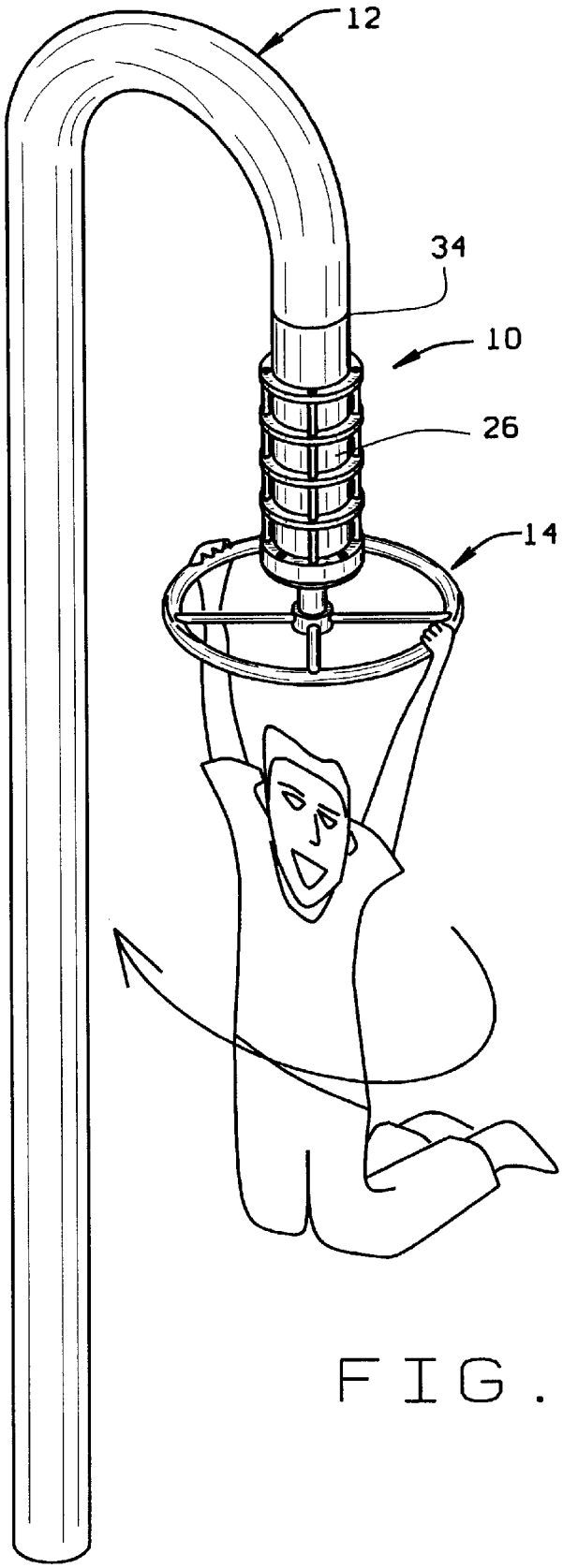
FIG. 1 is a perspective view of one illustrative embodiment showing the spinning play device of the present invention attached to a support and in use by a user.

In FIG. 1, the preferred embodiment of the spinning play device 10 is shown as being as attached to a frame or support 12 with a wheel-shaped handhold 14 depending from the spinning play device 10.

Figure 2:
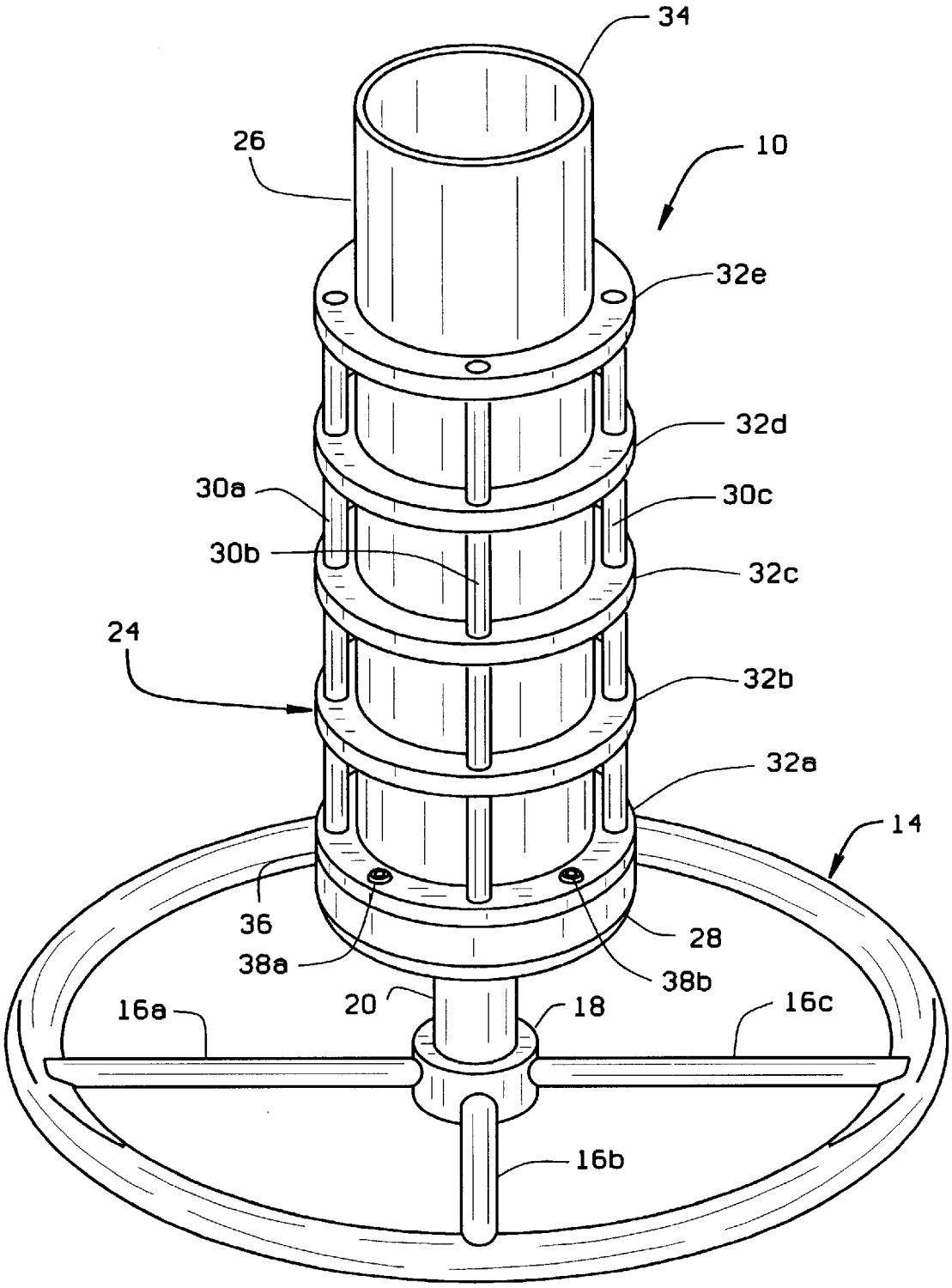
FIG. 2 is an enlarged perspective view of the spinning play device of FIG. 1.

FIG. 2 displays the spinning play device 10 and its depending handhold 14 with the frame or support 12 removed. The handhold 14 in this embodiment is a wheel with four spokes, three of the spokes being shown as 16*a,* 16*b,* and 16*c*. Each spoke is co-planar with the wheel, of equal length, and extends towards the center of the wheel. The spokes are joined at the diametrical center of the wheel by a hub 18, the top side of the hub 18 being fixed to a rotating tube or shaft 20, discussed later in this description.

The housing 24 of the spinning play device 10 is includes an outer casing 26, four longitudinal rods, (three rods of which are 30*a,* 30*b,* and 30*c*), and five annular flanges 32*a,* 32*b,* 32*c,* 32*d,* and 32*e,* the annular flanges having generally parallel planes. The outer casing 26 is a vertically aligned cylinder that is connected at 34, to the frame on support 12, as shown in FIG. 1. Alternatively, the outer casing 26 and support 12 may be integrally connected to one another. The longitudinal rods are equally spaced around the outer casing 26, the upper end of each rod being mounted in the top-most annular flange 32*e,* while the lower end of each rod is mounted in the bottom-most annular flange 32*a*. The other flanges 32*b,* 32*c,* and 32*d* are each spaced equidistant from each other and from the top-most and bottom-most flanges 32*e* and 32*a*. The bottom-most flange 32*a* is mounted to the top surface of the mounting base casting 28 at 36 by means of four bolts, two of the bolts 38*a* and 38*b* being shown. The annular flanges 32*a* through 32*e* extend around the outer casing 26, with the outer diameter of the annular flanges being equal to that of the mounting base casting 28. The described longitudinal rods and annular flanges are for decorative purposes only and are not part of the present invention.

Figure 3:
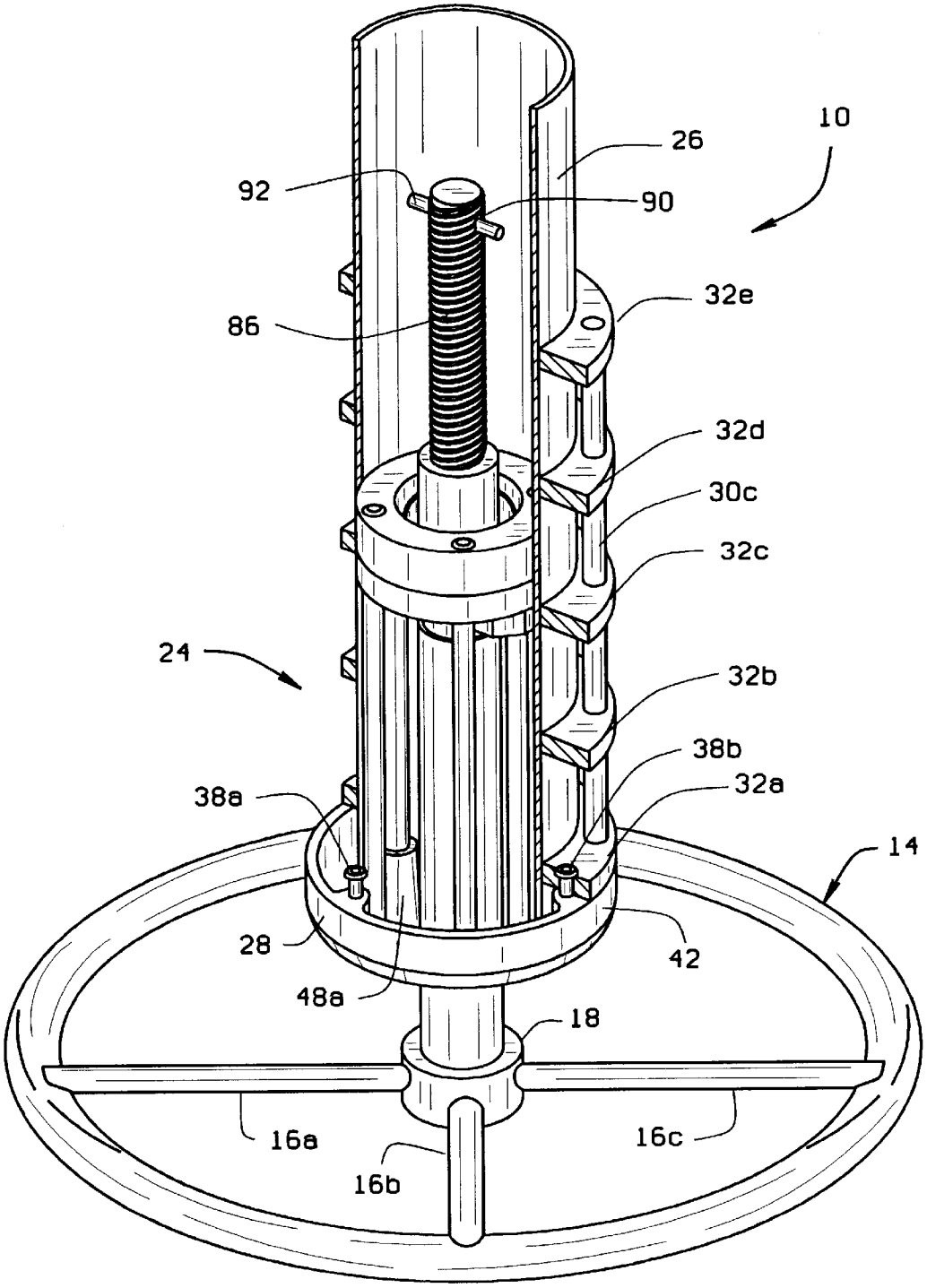
FIG. 3 is a partially cut away perspective view of the spinning play device shown in FIG. 2.
Figure 4:
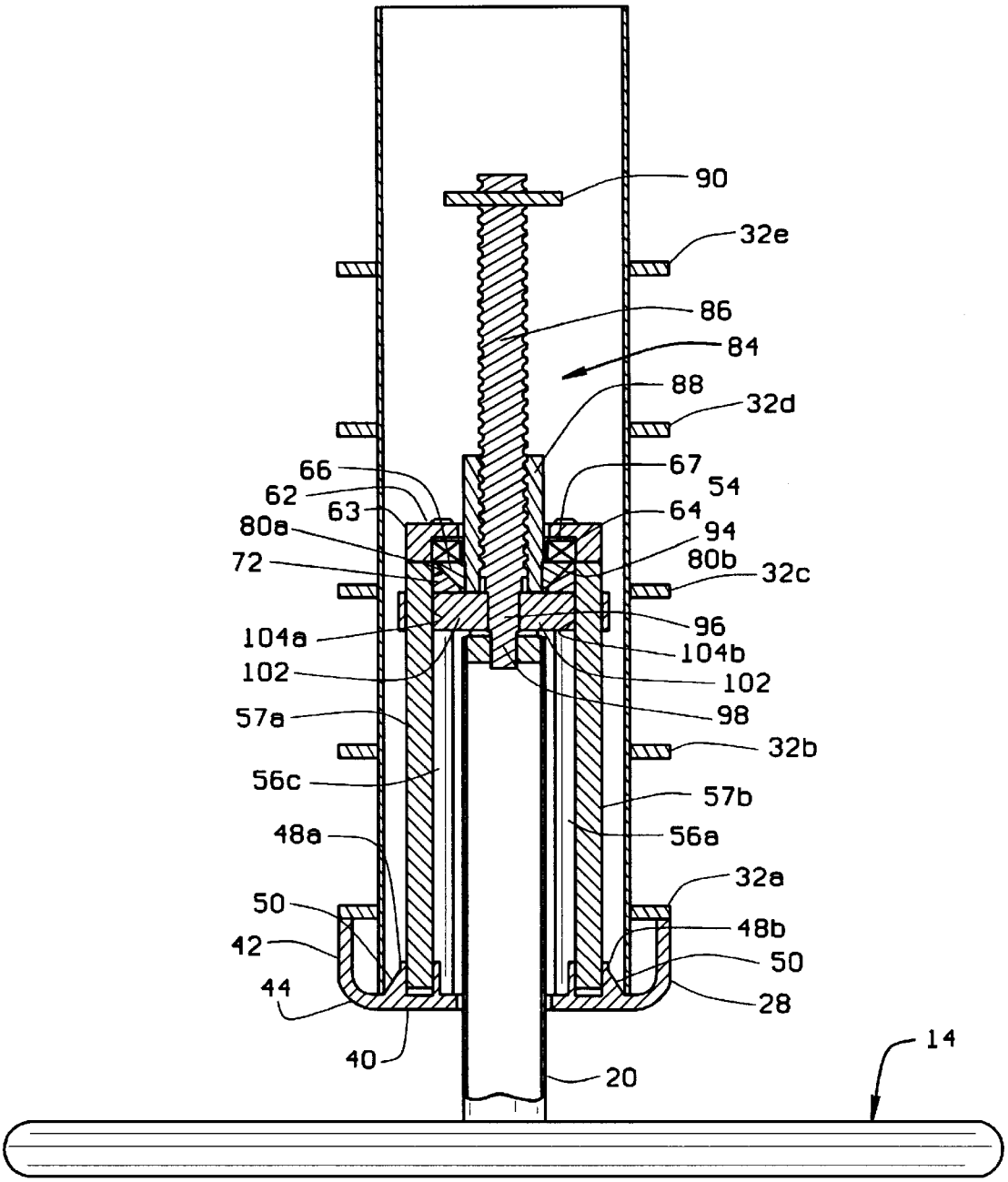
FIG. 4 is an elevational view, partially in section, of the spinning play device shown in FIG. 3 at its uppermost position.

As can be seen in FIG. 4, the mounting base casting 28 includes of an annular disc 40 formed integral with a longitudinally generally extending cylindrical wall 42. The cylindrical wall 42 extends from the angular wall 44 that is connected to the annular disc 40. The annular disc 40 has four holes (not shown) for receiving screws, each located an equal distance form the central axis and spaced evenly from each other. The annular disc 40 has two guide rail cups 48*a* and 48*b* which are located an equal distance from the central axis along a common diameter. The guide rail cups 48*a* and 48*b* are relatively short annular cylinders, each cup having four triangular side supports 50, located radially on the sides of the cup, equally spaced around the cup, connected to the top surface of the annular disc 44, for strengthening each cup. FIG. 3 shows the bolts, 38*a*, 38*b,* which mount the previously mentioned bottom-most annular flange 32*a* onto the mounting base casting 28.

Figure 5:
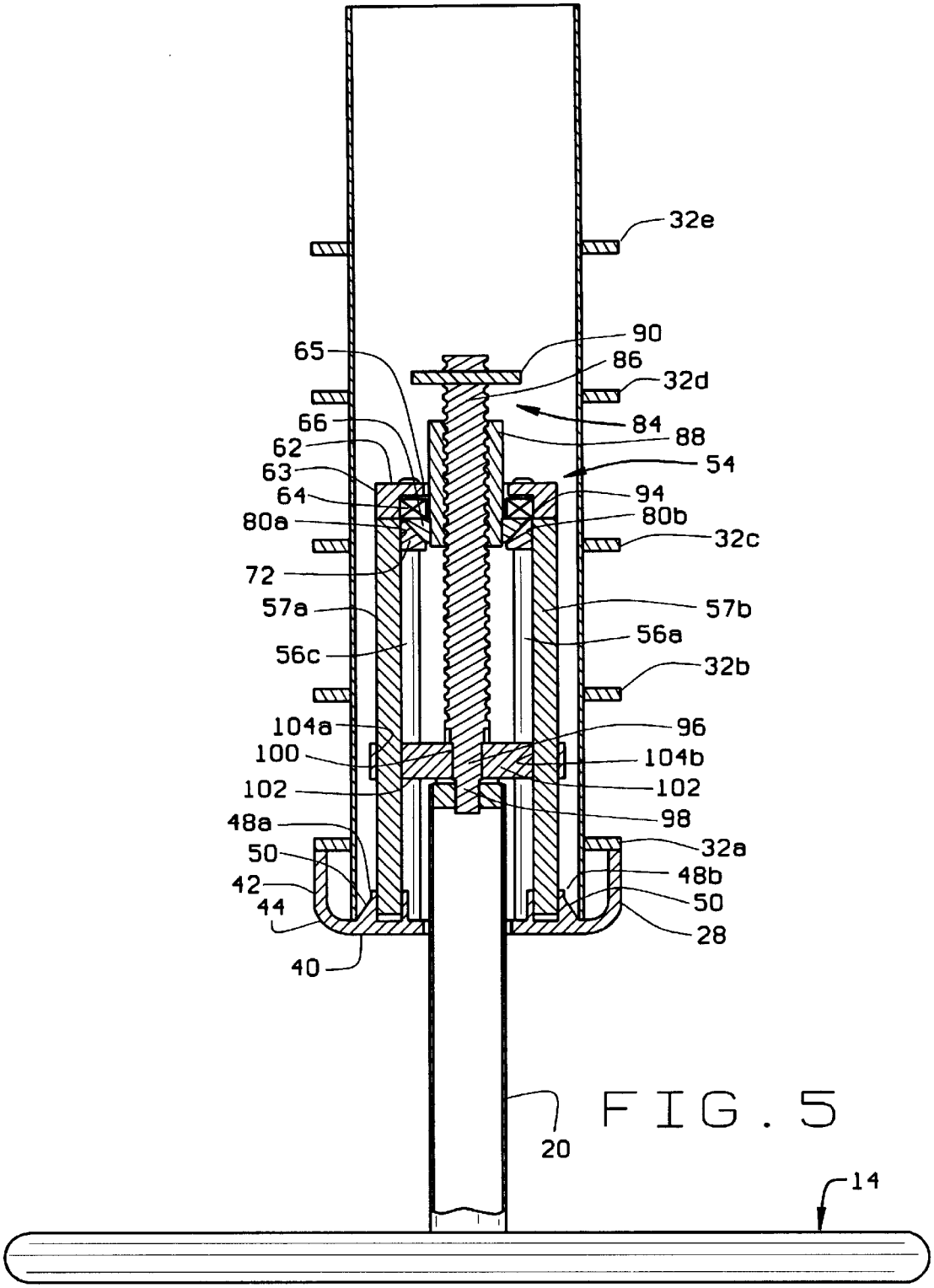
FIG. 5 is an elevational view, partially in section, of the spinning play device shown in FIG. 3 at an intermediate position.
Figure 6:
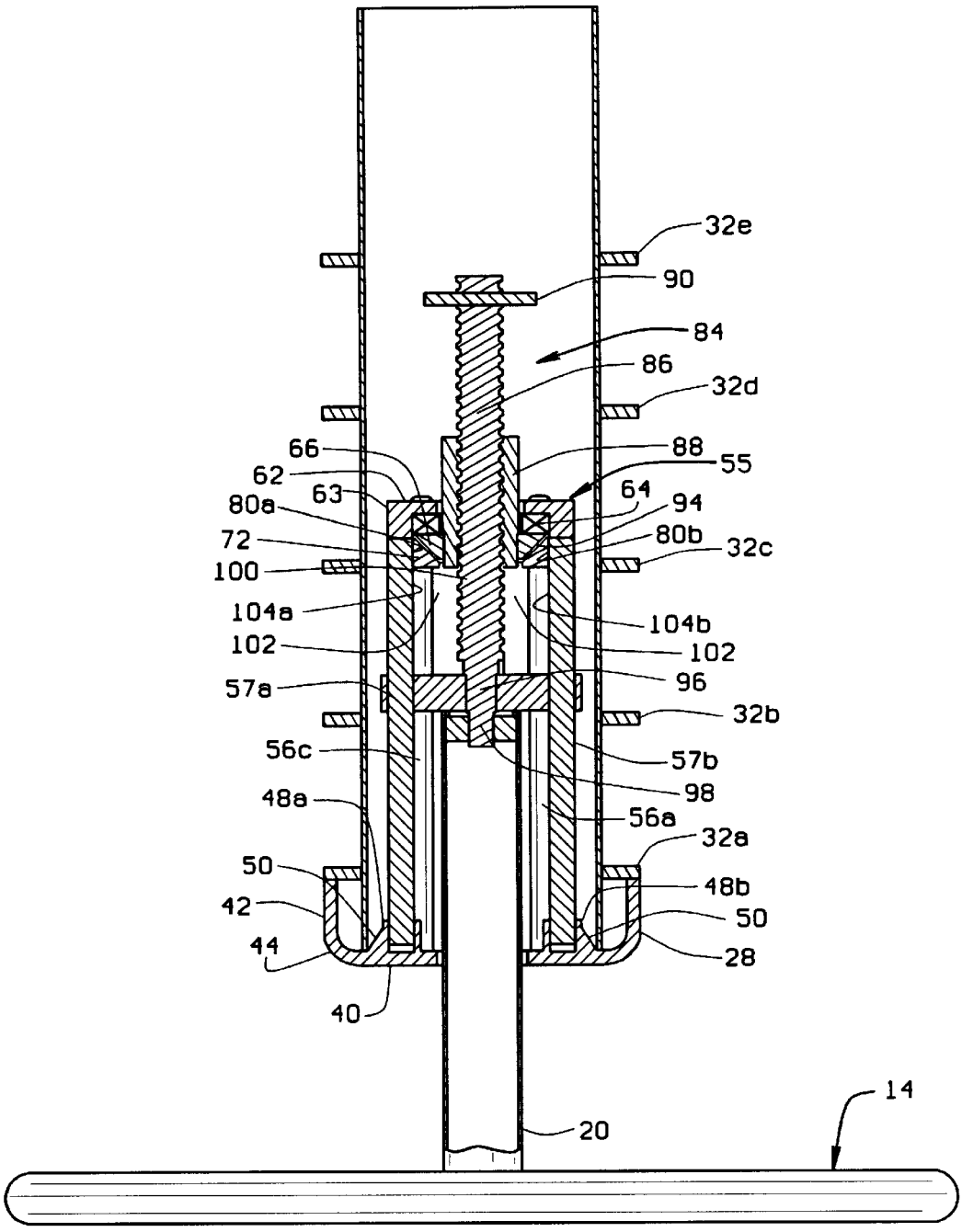
FIG. 6 is an elevational view, partially in section, of the spinning play device shown in FIG. 3 when moved from a lower to an uppermost position.
Figure 6A:
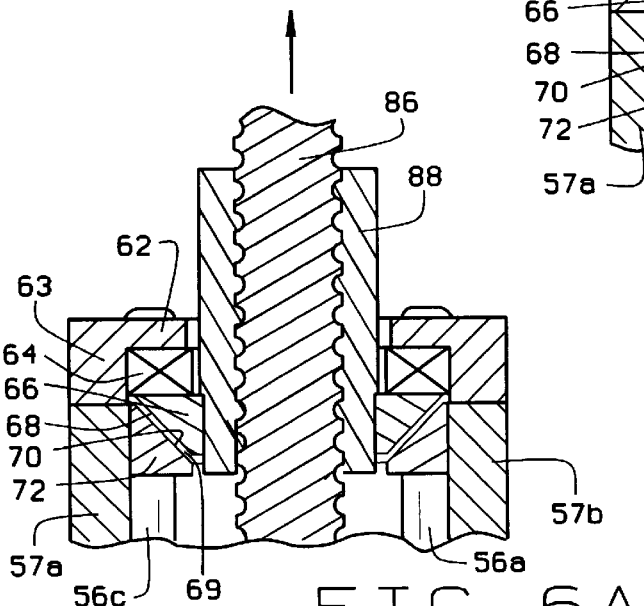
FIG. 6A is an enlarged fragmentary sectional view of the clutch mechanism when the spinning play device is moved from a lower to an uppermost position.

FIGS. 4–6 including FIGS. 4A–6A illustrate the operation of the spinning play device 10 while FIGS. 7–8 best depict the components of the spinning play device 10.

Each of FIGS. 4–8 show a rotating element collar bracket 54 and connecting standoffs 56*a,* 56*b,* 56*c* and 56*d*. The standoffs are parallel rods whose central axes are vertical and parallel to the central axis of the spinning play device 10. The top end of each standoff connects to the rotating element collar bracket 54 by means of four screws 60*a,* 60*b,* 60*c,* and 60*d* (FIGS. 7–8). The bottom end of each standoff connects to the mounting base casting 28 by four previously mentioned screws, 38*a* and 38*b* being shown.

Figure 4A:
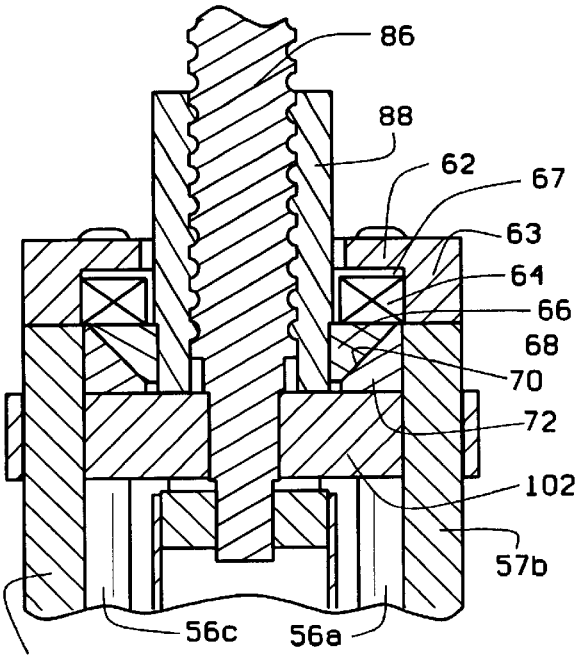
FIG. 4A is an enlarged fragmentary sectional view of the clutch mechanism when the spinning play device is in its uppermost position.
Figure 5A:
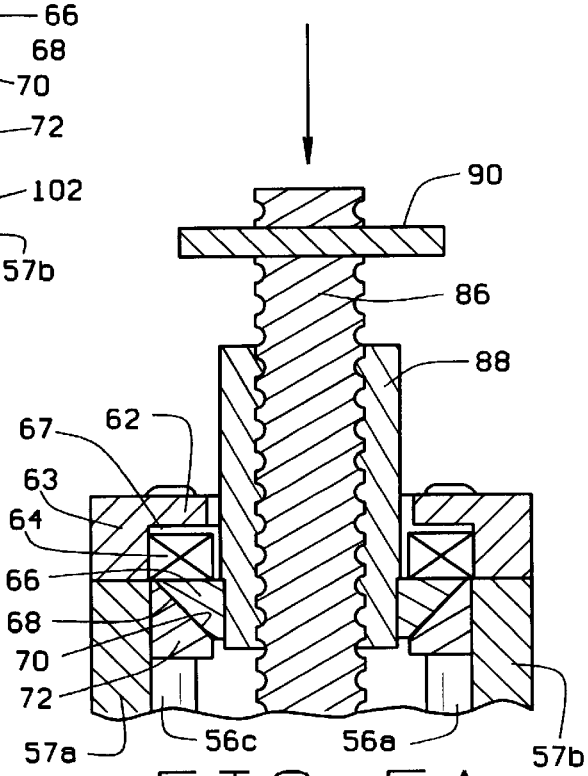
FIG. 5A is an enlarged fragmentary sectional view of the clutch mechanism when the spinning play device is in an intermediate position.

The rotating element collar bracket 54 includes a face plate 62 and a depending circumferential wall 63 for capturing a slip collar 64. The slip collar also includes a roller thrust bearing 65, as shown in FIGS. 7–8. As best seen in FIGS. 4A, 5A and 6A, immediately below the slip collar 64 is a movable friction collar 66 having a sloping surface 68 that is complementary to sloping surface 70 of fixed friction collar 72. The movable friction collar 66 is threadably connected along an inner wall to ball nut or cylindrical collar 88, while cylindrical collar 88 is threadably connected along its inner wall, to threaded shaft 86, in order to form the rotating element 84. Threaded shaft 86 provides the desired rotating movement for the user when the spinning play device 10 is moved from its uppermost to its downwardmost position, as will become apparent.

The threaded shaft 86, at its lower end, has a guide piece axle 96 that slidably receives the guide piece 102 and a tube mount axle 98 that enables the tube or shaft 20 to be fixedly mounted to the threaded shaft 86. The guidepiece 102 is mounted in vertically constrained movement on the threaded shaft 86 while permitting rotation of the threaded shaft 86 relative to the guidepiece 102 through the guidepiece axle 96. The tube or shaft 20 is connected at its lower end to the handhold 14. The guidepiece 102 has spaced openings 104*a,* 104*b* for slidably mounting same relative to the guide rails 56*c,* 56*a*. Thus, as the threaded shaft 86 moves downwardly from its uppermost position shown in FIG. 4 to that illustrated in FIG. 5, the threaded shaft 86 rotates relative to the cylindrical collar 88, while the guidepiece 102 permits rotational movement of the threaded shaft 86, through the guidepiece axle 96, and at the same time, enables the guidepiece 102 to vertically slide along the guide rails 56*c,* 56*a*. This structure provides lateral strength and support to the threaded shaft 86 during its rotation.

The fixed friction collar 72 is secured by the screws 60*a* through 60*d* to the connecting standoffs 56*a* through 56*d*. See FIGS. 7–8. Movable friction collar 66 through its sloping surface 68, frictionally engages non-rotatable friction collar 72 through its sloping surface 70, during downward rotating movement of the threaded shaft 86 that results from the user gripping the handhold 14 and allowing the user's weight to actuate the downward rotational movement of the threaded shaft 86. As will be appreciated, such downward force causes the complementary sloping surfaces 68, 70 of the friction collars 66, 72 to frictionally engage one another and prevent rotary movement of the cylindrical collar 88. As noted above, the movable friction collar 66 and the cylindrical collar 88 operate together as one since they are threadably connected to one another. By restricting rotary movement of the cylindrical collar 88 and its associated movable friction collar 66, the threaded shaft 86 is able to rotate from its uppermost position illustrated in FIG. 4 to an intermediate position for example, as shown in FIG. 5.

As long as the user holds onto the handhold 14 allowing the weight of the user to rotate the threaded shaft 86, the threaded shaft 86 will move from its uppermost position shown in FIG. 4 to an intermediate position shown in FIG. 5. Continued rotating movement components of the spinning play device 10, is permitted until the stop 90, extending through an opening at an upper end of the threaded shaft 86, engages the upper end of the cylindrical collar 88. At this point, rotary downward movement of the threaded shaft 86 will terminate as the spinning play device 10 will have completed its rotation when moved to its lowermost position.

It would be impractical and time consuming to rotate threaded shaft 86 from its lowermost position to its uppermost position shown in FIG. 4. Accordingly, the spinning play device 10 has a clutch that permits the threaded shaft 86 to be moved linearly upwardly from its lowermost to its uppermost position. The clutch includes components previously described.

Specifically, when the threaded shaft 86 is pushed upwardly to return same to its uppermost position, the frictional contact between the fixed friction collar 72 and the movable friction collar 66 is broken as at 69 in FIG. 6A, thus eliminating friction. This breaking in the frictional contact between fixed friction collar 72 and movable friction collar 66 is permitted since there is an initial small or minimal vertical gap 67 between the slip collar 64 and its associated collar thrust bearing 65 and the face plate 62 of the rotating element collar bracket 54, as shown in FIGS. 4–5. As a result, the cylindrical collar 88 and associated movable friction collar 66 will freely rotate relative to the threaded shaft 86 as the threaded shaft 86 is vertically moved upwardly. The roller thrust bearing 65 on the slip collar 64 allows the ball nut or cylindrical collar 88 and its associated movable friction collar 66 to freely rotate relative to the rotating element collar bracket 54. Thus, there is nothing that will impede threaded shaft 86 in direct linear upward movement relative to the other components of the spinning play device 10. The net effect is that return of the threaded shaft 86 and associated cylindrical collar 88 to its uppermost position is quickly and conveniently accomplished through direct linear upward movement of the threaded shaft 86.

The relative positions of the movable and fixed friction collars 66, 72 to one another and other closely associated components of the spinning play device 10 are best shown in FIGS. 4A, 5A and 6A of the drawings which represent their relative positions when the spinning play device 10 is in the respective positions shown in FIGS. 4, 5, and 6 of the drawings.

An alternative embodiment of the spinning play device is depicted in FIG. 9. Specifically, the support 110 may suspend multiple spinning play devices 112*a,* 112*b,* 112*c,* and 112*d.* This support may be, for example, a four-sided frame 114 with four legs 116*a,* 116*b,* 116*c,* and 116*d* terminating at 24 for resting on a floor or ground surface (not shown). The handhold may be any shape or configuration that allows a grip to be had, such as the handlebars 118*a*, 118*b,* 118*c,* and 118*d* shown. Preferably, though not necessarily, the rotating elements 28 shown in FIG. 6 are enclosed and not exposed to elements. Enclosing the rotating elements is also a safety precaution preventing playground users from injuring themselves on the moving parts.

In both FIGS. 1 and 9, the arrow depicting a direction of rotation is meant for illustrative purposes only. Obviously, the spinning play device in either illustrated embodiment may be constructed to rotate in any direction desired, depending on the right hand or left hand thread of the threaded shaft 86.

The spinning play device 10 in the FIG. 1 embodiment and the spinning play devices 112*a* through 112*d* in the FIG. 9 embodiment operate in the manner now to be described. If the threaded shaft 86 is in its uppermost position as shown in FIG. 4, with the handhold 14 in a raised position, the user will grip the handhold 14 and apply a downward force on the threaded shaft 86 through the user's weight. The threaded shaft 86 will rotate relative to the ball nut or cylindrical collar 88 which is restrained from rotating by the frictional contact between movable friction collar 66, that is fixedly threadably associated to the cylindrical collar 88, and the fixed friction collar 72, the latter being mounted in position by screws 60*a* through 60*d* to the connecting standoffs 56*a* through 56*d.* The frictional engagement between movable friction collar 66 and fixed friction collar 72 occurs along complementary associated sloping surfaces 68,70, respectively. As a result, the threaded shaft 86 is threadably moved downwardly relative to the cylindrical collar 88 which is fixed in position by the frictional contact between the movable friction collar 66 and fixed friction collar 72. Even as this downward rotating movement of the threaded shaft 86 occurs, the threaded shaft 86 is nonetheless able to rotate on the guide piece axle 96 of the threaded shaft 86 relative to guide piece. The guide piece 102, slidably mounted to the guideshafts 57*a* and 57*b,* provides a strong and secure lateral support for the threaded shaft 86 during its downward rotating movement.

At its lowermost position when the stop 90 at the upper end of the threaded shaft 86 engages the upper end of the cylindrical collar 88, rotation of threaded shaft 86 closes. If the user desires to use the spinning play device again, the user may simply push up on the handhold 14 to return the threaded shaft 86 by linear movement to its uppermost position. This linear movement is permitted by the clutch action incorporated into the spinning play device.

The clutch action occurs as the result of the small or minimal vertical gap 67 between the slip collar 64 and its associated roller thrust bearing 65 relative to the face plate 62 of the rotating element collar bracket 54. When the threaded shaft 86 is pushed upwardly, the small or minimal vertical gap 67 breaks the frictional contact between the movable friction collar 66 and fixed friction collar 72 as at 69, as shown in FIGS. 6 and 6A. This enables the cylindrical collar 88 and associated rotatable friction collar 66 to freely rotate relative to the threaded shaft 86 and thus permits the threaded shaft 86 to move linearly upwardly in a quick and convenient manner. The free rotation of the cylindrical collar 88 and associated movable friction collar 72 also enables these two elements to be moved upwardly relative to the threaded shaft 86 for return to the uppermost position of the spinning play device as shown in FIG. 4.

From the foregoing, it will now be appreciated that the spinning play device of the present invention provides a unique play experience; while affording practical and convenient operation by users.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

I claim:

1. A spinning play device comprising:

a rotating mechanism supported by a frame a predetermined distance above a ground surface by a frame, the rotating mechanism including a threaded rotating element; and a handhold depending from the rotating mechanism suspending a user during rotation of the rotating mechanism.

2. The spinning play device as defined in claim 1 in which the threaded rotating element is connected to a clutch to permit return of the threaded rotating element to an upper position by vertical movement only.

3. The spinning play device as defined in claim 1 including a housing that encloses the threaded rotating element.

4. The spinning play device as defined in claim 3 including a threaded collar operably connected to the threaded rotating element for downward rotating movement of the threaded rotating element relative to the threaded collar.

5. The spinning play device as defined in claim 4 including a clutch for disengaging the threaded collar to provide free rotation of the threaded collar relative to the threaded shaft for linear upward movement of the threaded shaft relative to the frame.

6. The spinning play device as defined in claim 3 in which the path of movement of the rotating mechanism is confined by guide rails.

7. The spinning play device as defined in claim 6 in which the rotating mechanism is slideably mounted relative to guide rails.

8. The spinning play device as defined in claim 1 in which the force of movement of the rotating element is provided by a user's weight.

9. A spinning play device comprising:

a rotating mechanism mounted to a frame a predetermined distance above a supporting surface, the rotating mechanism including a threaded rotating element; and a handhold depending from the rotating mechanism to allow a user to grip the handhold during rotation of the rotating mechanism.

10. The spinning play device as defined in claim 9 is which the rotating mechanism includes a housing fixed to the frame and a vertically moving rotating element within the housing that is connected to the handhold.

11. The spinning play device as defined in claim 10 in which the vertically moving rotating element is weight actuated.

12. The spinning play device as defined in claim 11 in which the vertically moving rotating element is connected to a clutch to permit return to an upper position by vertical movement only.

13. A spinning play device comprising:

a weight actuated rotating mechanism including a threaded rotating element that is mounted to a frame a predetermined distance above a supporting surface; and a handhold depending from the weight actuated rotating mechanism to enable a user to grip the handhold while allowing the weight of the user to rotate the weight actuated rotating mechanism.

14. A spinning play device, comprising:

a weight actuated rotating mechanism mounted to a frame a predetermined distance above a supporting surface;

a vertically moving threaded rotating element in the weight actuated rotating mechanism; and a handhold depending from the vertically moving threaded rotating element of the weight actuated rotating mechanism to enable gripping of the handhold by a user while allowing the weight of the user to actuate the vertically moving threaded rotating element of the weight actuated rotating mechanism.

15. A spinning play device, comprising:

a rotating mechanism mounted to a frame a predetermined distance above a supporting surface, the rotating mechanism including a generally vertically extending screw that provides both vertical and rotating movement relative to the frame when moved from an upper to a lower position; and a handhold depending from a lower end of the screw to allow a user to grip the handhold while allowing the weight of the user to move the screw from an upper to a lower position.

16. The spinning play device as defined in claim 15 in which is screw is threadably mounted to a complementary threaded nut within a housing mounted to the frame, the screw being mounted for both vertical and rotational movement relative to the complementary threaded nut.

17. The spinning play device as defined in claim 16 including a protective shaft surrounding the screw.

18. The spinning play device as defined in claim 17 including a clutch for disengaging the complementary threaded nut from the screw to facilitate return of the screw from a lower to an upper position by vertical movement only.

19. A spinning play device, comprising:

a rotating mechanism mounted to a frame a predetermined distance above a supporting surface, the rotating mechanism including a generally vertically extending screw that provides both vertical and rotating movement relative to the frame when moved from an upper to a lower position;

a handhold depending from a lower end of the screw to allow a user to grip the handhold while allowing the weight of the user to move the screw from an upper to a lower position; and a clutch in the rotating mechanism for returning the screw from a lower to an upper position by linear movement.

20. A spinning play device comprising a threaded rotating element engaged by an engageable/disengageable threaded collar and supported with a housing to provide rotational and linear movement of the threaded rotating element relative to the engageable/disengageable complementary threaded collar from an uppermost to a lowermost position, and a clutch disengaging the engageable/disengageable complementary threaded collar to provide linear movement solely for the threaded rotating element when moved from a lowermost to an uppermost position.

* * * * *